US007297033B2

(12) United States Patent
Sakamoto et al.

(10) Patent No.: US 7,297,033 B2
(45) Date of Patent: Nov. 20, 2007

(54) CONNECTOR

(75) Inventors: Nobuyuki Sakamoto, Shizuoka (JP); Tomihiko Nagayoshi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/594,771

(22) Filed: Nov. 9, 2006

(65) Prior Publication Data

US 2007/0111609 A1 May 17, 2007

(30) Foreign Application Priority Data

Nov. 11, 2005 (JP) ..... 2005-326891
May 26, 2006 (JP) ..... 2006-146215

(51) Int. Cl.
*H01R 13/502* (2006.01)

(52) U.S. Cl. ..... 439/701

(58) Field of Classification Search ..... 439/701, 439/247, 248
See application file for complete search history.

(56) References Cited

U.S. PATENT DOCUMENTS 3,701,083 A * 10/1972 Ziegler, Jr. ..... 439/248
5,217,386 A * 6/1993 Ohsumi et al. ..... 439/364
5,651,683 A * 7/1997 Shimamura et al. ..... 439/34
6,354,855 B2 * 3/2002 Annequin ..... 439/248

FOREIGN PATENT DOCUMENTS

JP 8-106949 4/1996

* cited by examiner

*Primary Examiner*—Phuong Dinh
(74) *Attorney, Agent, or Firm*—Kratz, Quintos & Hanson, LLP

(57) ABSTRACT

A connector for preventing a load from being applied to terminals, substrates, etc., after sub-connectors are fitted together. The connector has a plurality of first sub-connectors fixed to a substrate and a plurality of second sub-connectors paired with the corresponding first sub-connectors, and includes a male frame having a plurality of accommodating parts in which the second sub-connectors are separately accommodated so as to be freely movable and a female frame to which the male frame fits. The female frame accommodates the plurality of first sub-connectors such that the first sub-connectors are connected to the corresponding second sub-connectors. The connector further includes guide means for guiding each of the second sub-connectors into a connected position relative to the corresponding first sub-connector.

3 Claims, 17 Drawing Sheets

CONNECTOR

BACKGROUND OF THE INVENTION

1. Field of Invention

The present invention relates to a connector, and in particular, to a connector that has a plurality of first sub-connectors fixed to a substrate and a plurality of second sub-connectors paired with the corresponding first sub-connectors.

2. Description of Related Art

As a multipole connector having, for example, dozens of terminals, a division type connector is used in order to prevent terminal fittings from being inserted into wrong positions in the connector. Such a division type connector is divided into a female connector and a male connector. The female connector and the male connector are further divided into sub-connectors each of which being equipped with terminal fittings. The division type connector incorporates a pair of frames, one female and the other male. Defined in both the female and male frames are accommodating holes to accommodate the corresponding division sub-connectors.

Such sub-connectors are inserted into the accommodating holes of the corresponding frames and locked by a lance so as not to be disconnected from the frames. A lever having an arcuate cam groove is axially supported by one of the frames. A follower pin from which the other frame projects is axially supported in the cam groove. The lever is rotated to pull one frame into the other frame by the action of a lever rule accompanying this rotation, thereby simultaneously fitting the female sub-connectors and the corresponding male sub-connectors into their connections.

The connector described in Japanese Patent Application Laid-Open No. 8-106949 includes groups of female sub-connectors and groups of male sub-connectors paired with the corresponding groups of female sub-connectors. Each group of female sub-connectors and corresponding group of male sub-connectors forming a pair are accommodated in corresponding accommodating holes such that the female sub-connectors and male sub-connectors cannot move in a direction perpendicular to the direction in which both female and male frames are brought into close contact with each other. This makes it possible to fit together the female and male sub-connectors straight, thereby improving the reliability of electrical connections of female and male terminal fittings.

However, where a positioning structure as in the connector described above uses a displacement spring or the like in order to fit the female and male sub-connectors into their connections, the pressing force of such a displacement spring is applied to the sub-connectors even after their connections. This pressing force results in a load on connection parts of the substrates of the sub-connectors, which is undesirable because the terminals or substrates of the sub-connectors may remain subject to a load even after their connections.

SUMMARY OF THE INVENTION

The present invention has been made in view of the drawbacks discussed above. It is therefore an object of the invention to provide a connector that prevents a load from being applied on terminals, substrates, etc., after sub-connectors are fit into their connections.

In order to achieve the above object, according to one aspect of the present invention, there is provided a connector having a plurality of first sub-connectors fixed to a substrate and a plurality of second sub-connectors paired with the corresponding first sub-connectors. The connector includes a male frame having a plurality of accommodating parts in which the second sub-connectors are separately accommodated so as to be freely movable. The connector also includes a female frame to which the male frame fits into its connection, the female frame accommodating the plurality of first sub-connectors such that the first sub-connectors are connected to the corresponding second sub-connectors. The connector further includes guide means for guiding each of the second sub-connectors into a connected position relative to the corresponding first sub-connector.

According to the connector, the male frame has the accommodating parts to separately accommodate the plurality of second sub-connectors such that the second sub-connectors are freely movable. The female frame, which fits into its connection to the male frame, accommodates the plurality of first sub-connectors that fit into their connections to the corresponding second sub-connectors. As the male frame and the female frame are fit together, each second sub-connector is guided into the connected position relative to the corresponding first sub-connector by the guide means. Accordingly, even if there are variations in the terminals, etc., of each first sub-connector and corresponding second sub-connector, the second sub-connector, which is freely movable, is guided to the connected position relative to the first sub-connector. Thus, the first sub-connector and the second sub-connector are connected and held in position.

In the connector, the guide means includes arms which extend from each of the first sub-connectors toward the corresponding second sub-connector, and enter the male frame so as to come into contact with the second sub-connector. The guide means also includes abutting parts formed on each second sub-connector, each abutting part being adapted such that the corresponding arm can be brought into contact with the abutting part. The guide means further includes tapered parts formed on at least the arms or the abutting parts, each tapered part inclining such that when the male frame and the female frame are fit together, the first sub-connector and the corresponding second sub-connector are guided into the connected position.

Accordingly, as the male frame and the female frame are fit together, the arms of each first sub-connector enter the male frame and come into contact with the abutting parts of the corresponding second sub-connector. Consequently, the first sub-connector and the second sub-connector are guided into the connected position by the tapered parts, so that the first and second sub-connectors are connected and held in position.

Further, the guide means includes a plate-formed guide part which extends from each first sub-connector toward the corresponding second sub-connector and enters the male frame so as to come into contact with the second sub-connector. The guide means also includes a guide hole defined in the corresponding second sub-connector. The guide hole receives the guide such that as the male frame and the female frame are fit together, the first sub-connector and the corresponding second sub-connector are guided into the connected position.

Accordingly, as the male frame and the female frame are fit together, the guide part of each first sub-connector enters the corresponding guide hole of the male frame. Consequently, each first sub-connector and the corresponding second sub-connector are guided to the connected position by the guide and the guide hole so that the first and second sub-connectors are connected and held in position.

In addition, each of the first sub-connectors has a plurality of terminals, and the male frame has through-holes into which the terminals of the first sub-connectors are inserted.

Accordingly, when the terminals of each first sub-connector enter the through-holes of the male frame, the first sub-connector and the corresponding second sub-connector are guided into the connected position by the guide means, so that the first and second sub-connectors are connected and held in position.

In one advantageous arrangement of the connector of the invention, the male frame has the accommodating parts to separately accommodate the plurality of second sub-connectors such that the second sub-connectors are freely movable. The female frame, which fits into its connection to the male frame, accommodates the plurality of first sub-connectors that fit into their connections to the corresponding second sub-connectors. As the male frame and the female frame are fit together, each second sub-connector is guided into the connected position relative to the corresponding first sub-connector by the guide means. Accordingly, even if there are variations in the terminals, etc., of each first sub-connector and corresponding second sub-connector, the second sub-connector, which is freely movable, is guided to the connected position relative to the first sub-connector. Thus, the first sub-connector and the second sub-connector are connected and held in position. Additionally, in the case where each first sub-connector or second sub-connector has terminals, the terminals have been formed by mechanical processes, the tolerance of which may result in variations in the leading ends of the terminals and variations in the terminal. However, since each accommodating part of the male frame accommodates the second sub-connector such that the second sub-connector is freely movable, the variations are absorbed such that the second sub-connector can be guided to the connected position. This eliminates the need to provide biasing means, such as a displacement spring, in order to connect and fix each first sub-connector and the corresponding second sub-connector. As a consequence, a load is prevented from being generated on the terminals, substrates, etc. after connection of the first and second sub-connectors.

In another advantageous arrangement of the connector of the invention, the arms of each first sub-connector enter the male frame and come into contact with the abutting parts of the corresponding second sub-connector. Consequently, the first sub-connector and the second sub-connector are guided into the connected position by the tapered parts, so that the first and second sub-connectors are connected and held in position. Accordingly, even if there is an error in the shape of the second sub-connector, the tapered parts accept the error, thus assuring the guide part of the first and second sub-connectors into the connected position.

In another advantageous arrangement of the connector of the invention, as the male frame and the female frame are fit together, the guide part of each first sub-connector enters the corresponding guide hole of the male frame. Consequently, each first sub-connector and the corresponding second sub-connector are guided to the connected position by the guide and the guide hole, so that the first and second sub-connectors are connected and held in position. Accordingly, even if an error occurs in the shape of the second sub-connector, the tapered parts accept the error, thus assuring the guide part of the first and second sub-connectors into the connected position.

In still another advantageous arrangement of the connector of the invention, the male frame has the through-holes into which the terminals of the plurality of first sub-connectors are inserted. This makes it possible to temporarily position the second sub-connectors relative to the corresponding first sub-connectors, thus making it easy to fit the connectors together.

DESCRIPTION OF THE PREFERRED EMBODIMENTS

Now, embodiments of a connector according to the present invention will be described with reference to FIGS. 1 to 12.

First Embodiment

Figure 1:
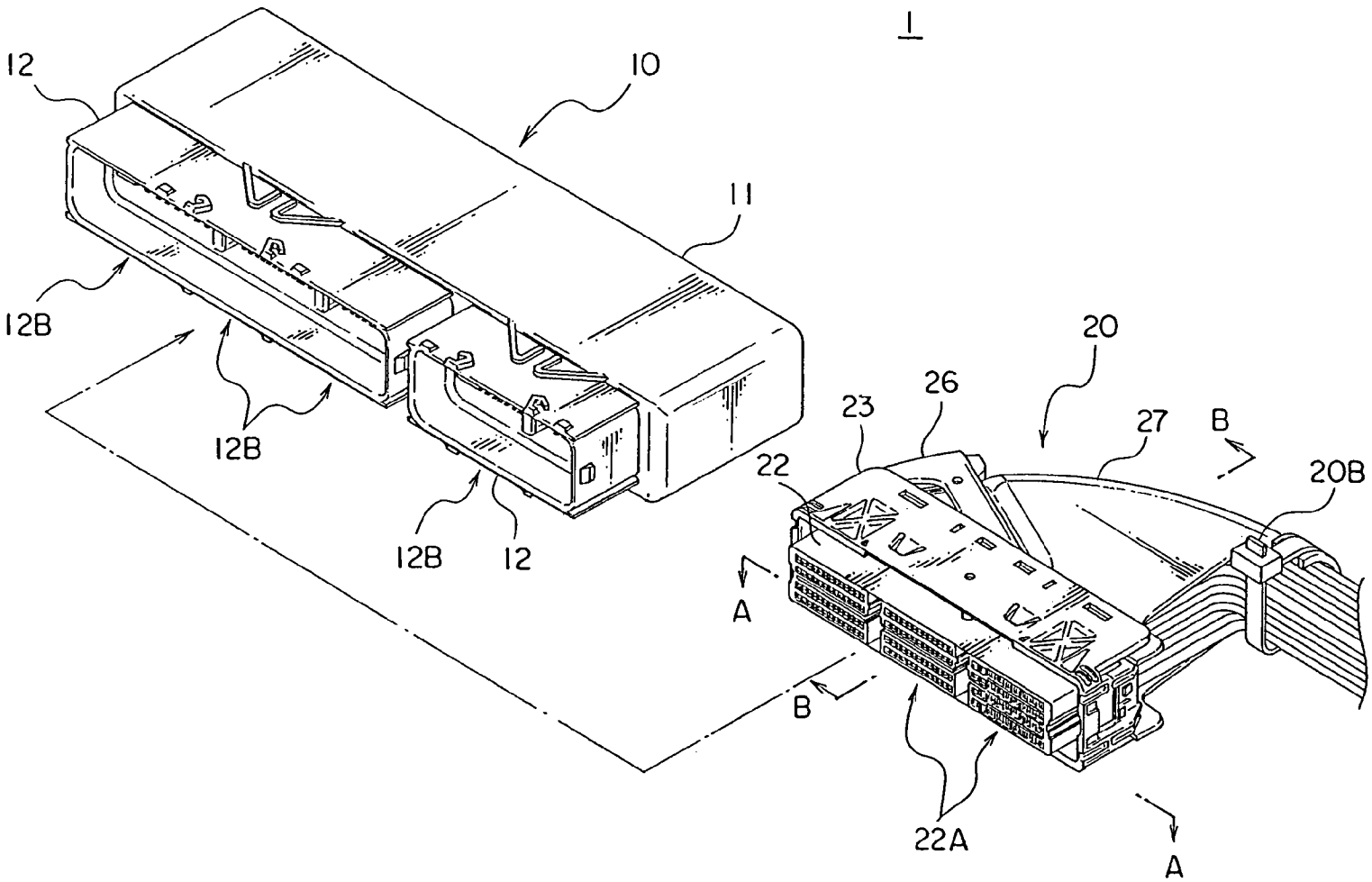
FIG. 1 is an external view schematically showing an example of an outline of a connector according to the present invention.

A connector 1 shown in FIG. 1 has one connector 10 (referred to as female connector) serving as a female frame, and a plurality of mating connectors 20 (referred to as male connector) serving as male frames which fit into their connections to the one female connector 10. In the preferred embodiment, two male connectors 20 can be connected to the one connector 10. However, FIG. 1 shows only one male connector 20, and the other one is not shown.

Figure 2:
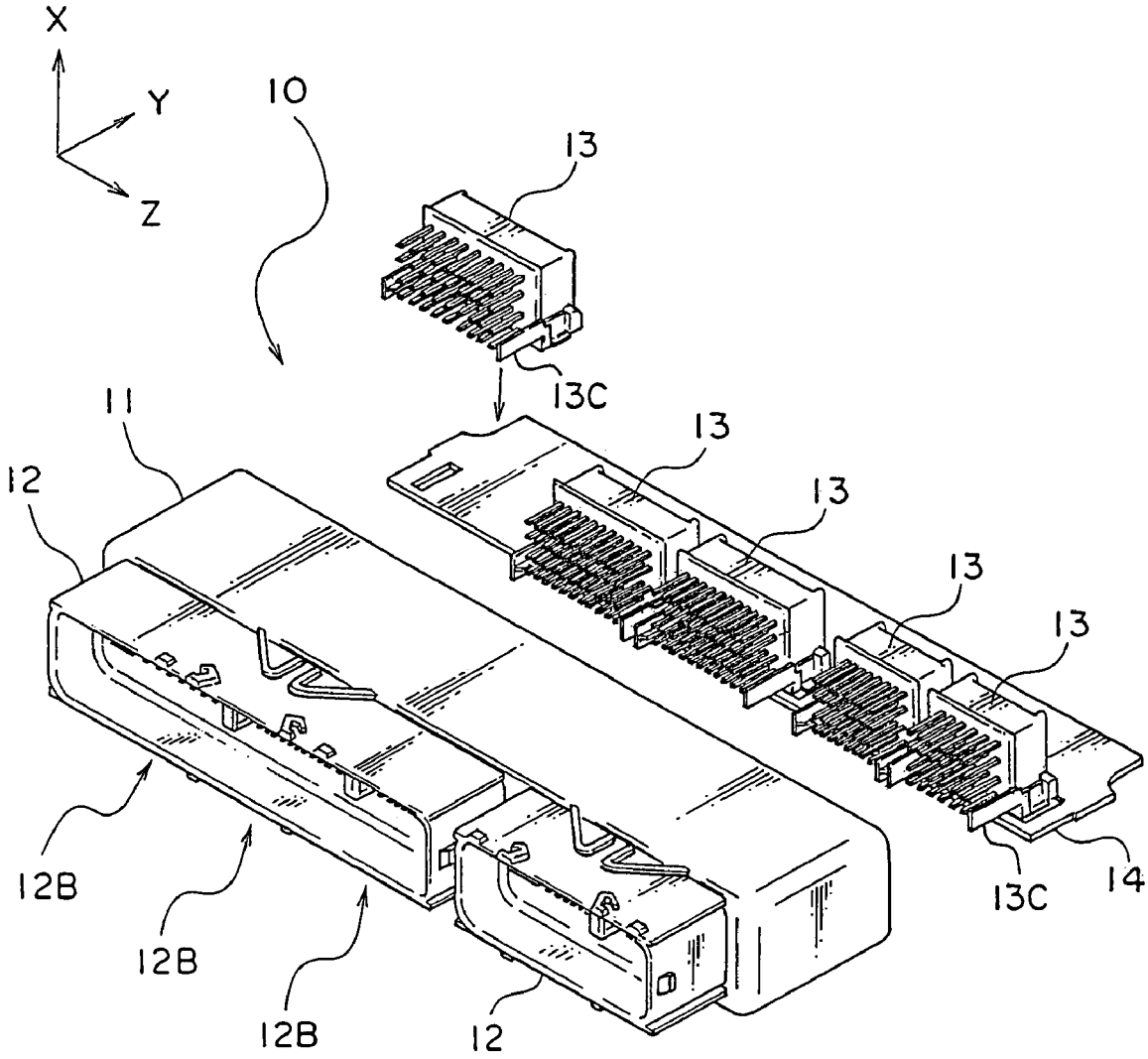
FIG. 2 is an exploded perspective view showing an example of one connector shown in FIG. 1.

As shown in FIGS. 1 and 2, the female connector 10 includes: a substantially box-like housing 11 made of synthetic resin or the like; female fitting parts 12 which are defined in the housing 11 and into which the corresponding male connectors 20 fit; a plurality of first sub-connectors 13 (the five first sub-connectors 13 in FIG. 5) which are accommodated in the housing 11; and a substrate 14 to which the first sub-connectors 13 are fixed.

The housing 11 has a fixing part (not shown) to which the substrate 14 is fixed. By fixing the substrate 14 to the fixing part, the first sub-connectors 13 are fixed in predetermined positions in the female fitting part 12.

Figure 3:
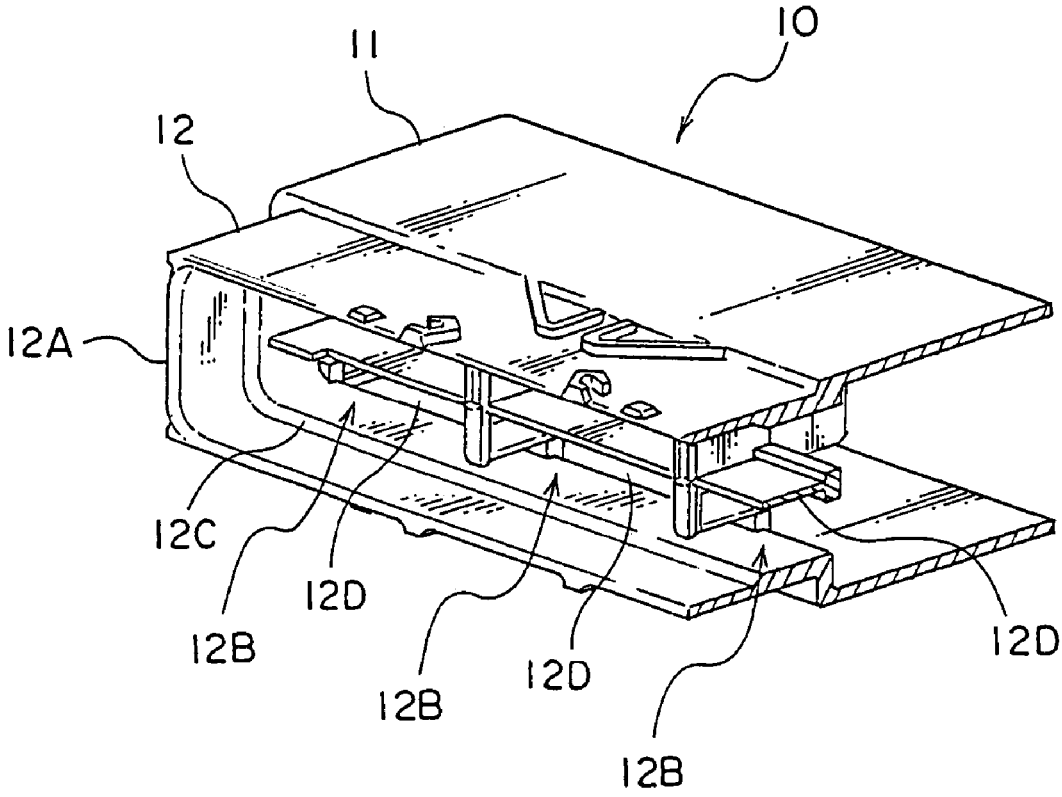
FIG. 3 is a partially broken view of the one connector shown in FIG. 2.

As shown in FIG. 2 or 3, each female fitting part 12 is made of synthetic resin or the like and extends from the housing 11. The female fitting part 12 includes a peripheral wall 12A, a plurality of fitting holes 12B defined by the peripheral wall 12A; a step 12C formed on the internal face of the peripheral wall 12A; and guide pieces 12D formed in the fitting holes 12B.

The peripheral wall 12A is made of synthetic resin or the like so as to cover the end of the corresponding male connector 20 that fits in the female fitting part 12. Namely, the peripheral wall 12A is shaped to match the corresponding male connector 20. Each of the fitting holes 12B is shaped to match the outside of each of second sub-connectors (described below) 21 of the corresponding male connector 20. In this preferred embodiment, the shapes of the three fitting holes 12B are identical. However, if the second sub-connectors 21 are shaped differently, the shapes of the first fitting holes 12B are also changed so as to match them.

The step 12C extends inwards from the internal face of the peripheral wall 12A by a predetermined length. By bringing the abutting parts of the male connector 20 into contact with the step 12C, movement of the male connector 20 is restricted in the direction in which the male connector 20 is inserted. Each of the guide pieces 12D extends between the sidewalls defining each fitting hole 12B so as to cross each fitting hole 12B widthwise. Each guide piece 12D enters the corresponding sub-connector 21 of the male connector 10, thereby blocking vertical movement (direction X in FIG. 2) of the second sub-connector 21 and guiding the second sub-connector 21 in the direction (direction Y in FIG. 2) of its insertion.

Figure 4:
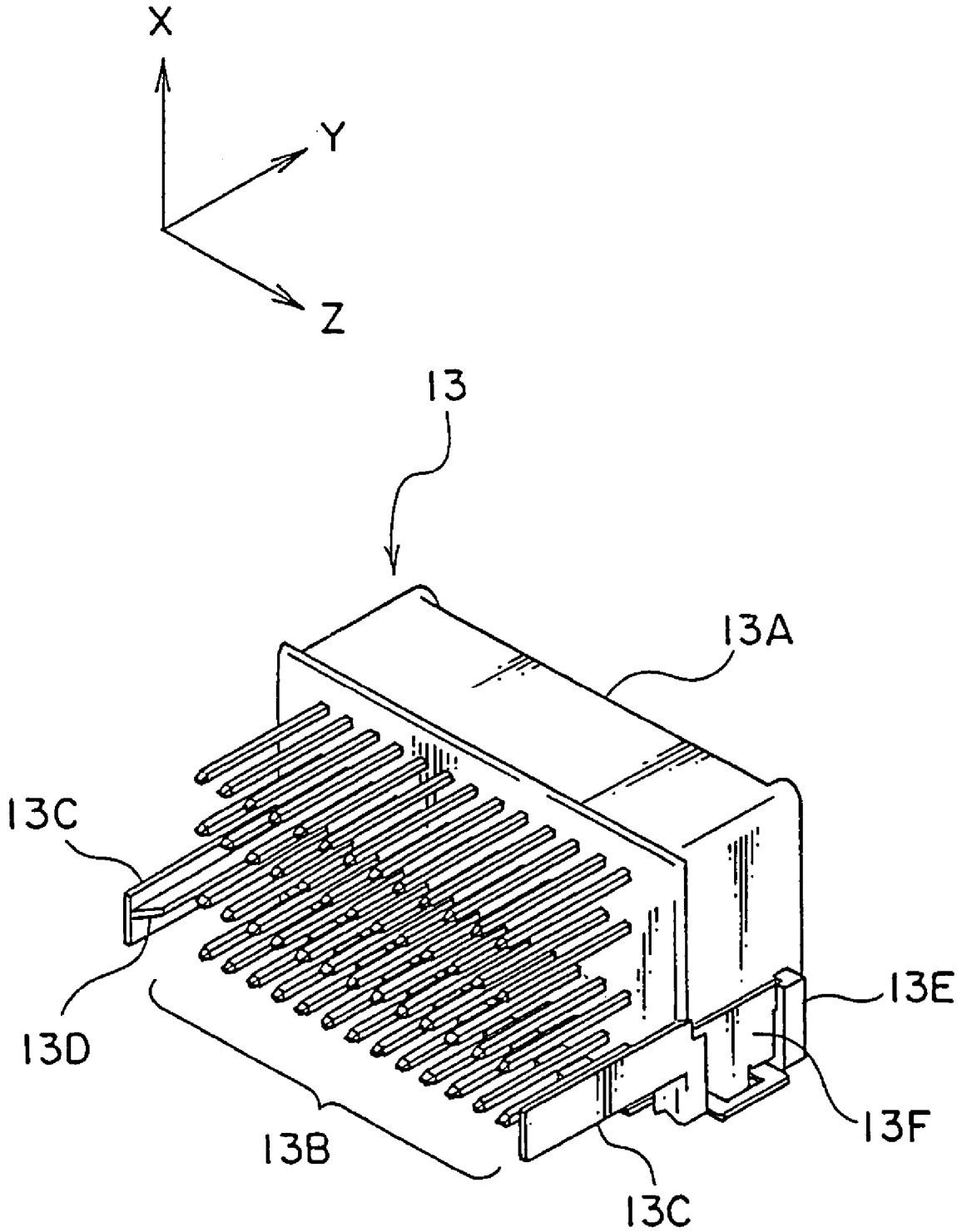
FIG. 4 is an external view showing one example of a first sub-connector shown in FIG. 2.

As shown in FIG. 4, each first sub-connector 13 includes: a connector base 13A, a plurality of terminals 13B extending from the connector base 13A toward the corresponding second sub-connector 21; a pair of arms 13C extending from both ends of the connector base 13A toward the second sub-connector 21; tapered parts 13D formed on the arms 13C; and engagement parts 13E formed on both sidewalls of the connector base 13A.

The connector base 13A is substantially in the shape of a box and made of synthetic resin or the like. A plurality of terminals 13B (described below) are attached to the connector base 13A by means of insert molding, press fitting, or the like. Each of the terminals 13B is of a metal plate material formed in a predetermined shape by means of punch molding or etching. Examples of the metal plate material include aluminum (Al), copper (Cu), a copper alloy such as Cu—Fe, Cu—Fe—P, Cu—Cr, Cu—Ni—Si, or Cu—Sn, a nickel-iron alloy such as Ni—Fe or Fe—Ni—Co, or a composite member of copper and stainless steel. These metals may be plated with nickel, silver, or gold.

As for the arrangement of the terminals 13B, a predetermined number (e.g., thirteen) of terminals 13B are arranged parallel to one another widthwise (direction Z in FIG. 4) of the connector base 13A. Four rows of terminals are arranged vertically (direction X in FIG. 4). Arrangement of the terminals 13B may be varied according to, for example, the specifications of the connector 10.

Each terminal 13B is substantially L-shaped (not shown) such that its one end extends toward the second sub-connector 21 as described above and its other end projects from the bottom of the connector base 13A toward the substrate 14. The other end of each terminal 13B is made to pass through the terminal hole of the substrate 14, soldered or press-fit, and thereby electrically connected to a wiring pattern formed on the substrate 14. Alternatively, surface mounting may be adopted such that the other end of each terminal is directly soldered onto the wiring pattern on the substrate 14.

The arms 13C are formed on both sides of the connector base 13A so as to extend further forward than one end of each terminal 13B. In this case, taking account of the maximum error of the second sub-connector 21, a distance between the pair of arms 13C is predetermined so that the arms 13C enter the corresponding male connector 20 and come into contact with the second sub-connector 21. Even if the maximum error occurs in the second sub-connector 21, contact between the pair of arms 13 and the second sub-connector 21 is assured.

The internal face of each arm 13C has the tapered part 13D. When the female connector 10 and the male connector 20 are fit together, the tapered parts 13D guide the first sub-connector 13 and second sub-connector 21 into a predetermined connected position. For example, the tapered parts 13D are formed such that the distance between the faces of opposite guides 13C1 is gradually narrowed as the second sub-connector 21 is moved in the direction of insertion (direction Y in FIG. 4). Thereby, the tapered parts 13D guide the second sub-connector 21 to the connected position while restricting the movement of the second sub-connector 21 in the direction of insertion of the sub-connector 21. In the preferred embodiment, a description will be given in the case where one of the pair of arms 13C has the tapered part 13D. However, each of the arms 13C may have the tapered part 13D.

Each engagement part 13E is temporarily positioned on a predetermined part of the substrate 14 by attaching a locking part 13F to the connector base 13A and inserting or soldering the locking piece 13F into or to the substrate. Formed on the substrate 14 is a wiring pattern (not shown) comprising a circuit by its being connected to each terminal 13B, etc., of the first sub-connector 13. Terminals, electric wires, etc. (not shown) are externally connected to the substrate 14, thereby supplying power or outputting or inputting various signals via the terminals 13B.

The female connector 10 described above is accommodated into the housing 11 after each first sub-connector 13 is mounted on the predetermined position of the substrate 14. Namely, the terminals 13B of each of the first sub-connectors 13 are arranged in the corresponding female fitting part 12 so as to extend in the direction of the second sub-connector 21. Thus, the female connector 10 is completed.

Figure 5:
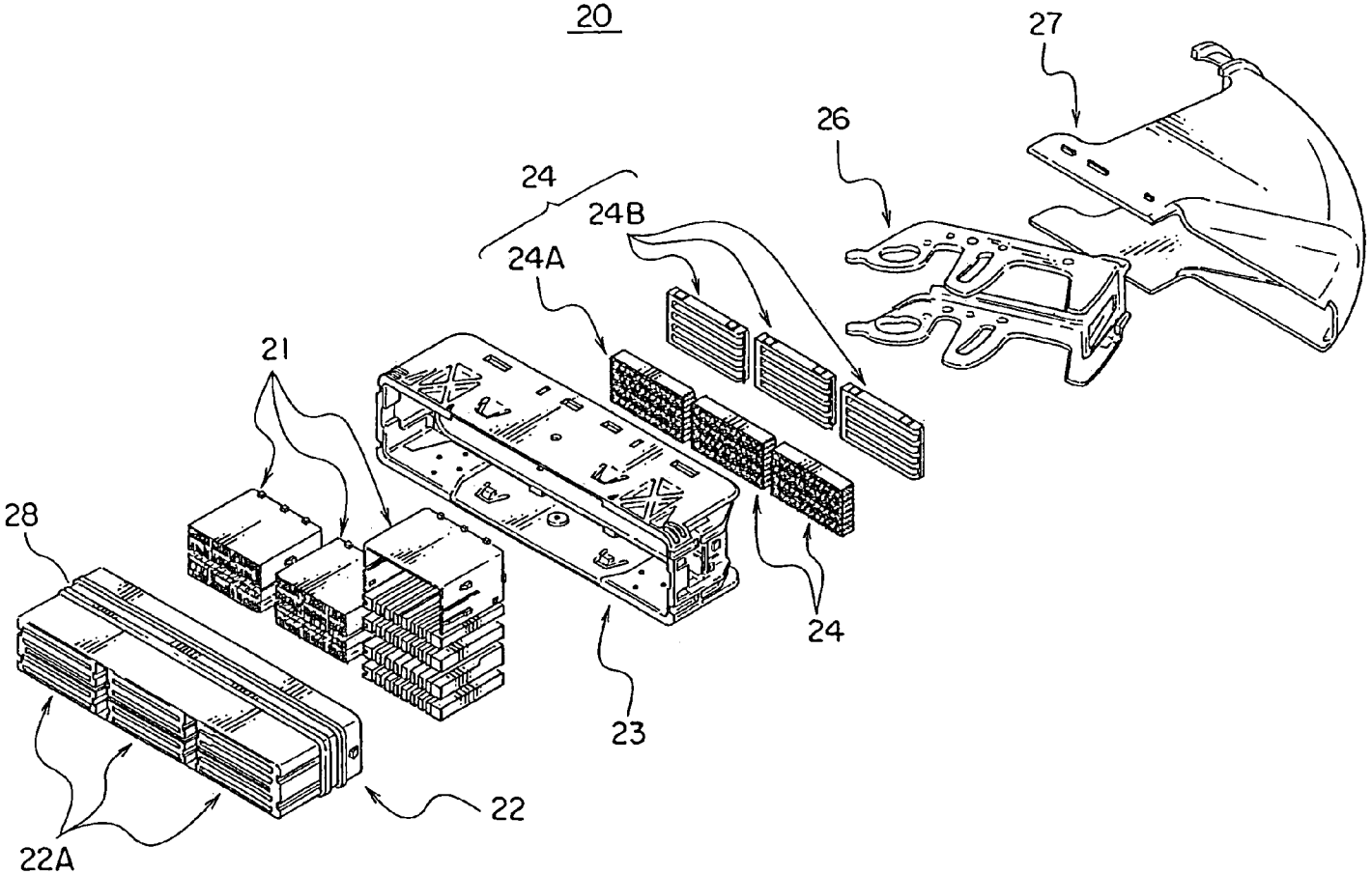
FIG. 5 is an exploded perspective view showing an example of a mating connector shown in FIG. 1.

As shown in FIG. 5, the male connector 20 includes: a plurality of second sub-connectors 21 (in FIG. 5, three sub-connectors), each forming a pair with the corresponding first sub-connector 13: a fitting part 22 for accommodating the second sub-connectors 21; a holder 23 for accommodating the fitting part 22 and the second sub-connectors 21; sealing members 24 provided so as to correspond with the second sub-connectors 21; a lever 26 for receiving and connecting the first sub-connectors 13 and second sub-connectors 21 simultaneously; a cover 27 covering electric wires 2 connected to the second sub-connectors 21; and a waterproof member 28.

Figure 6:
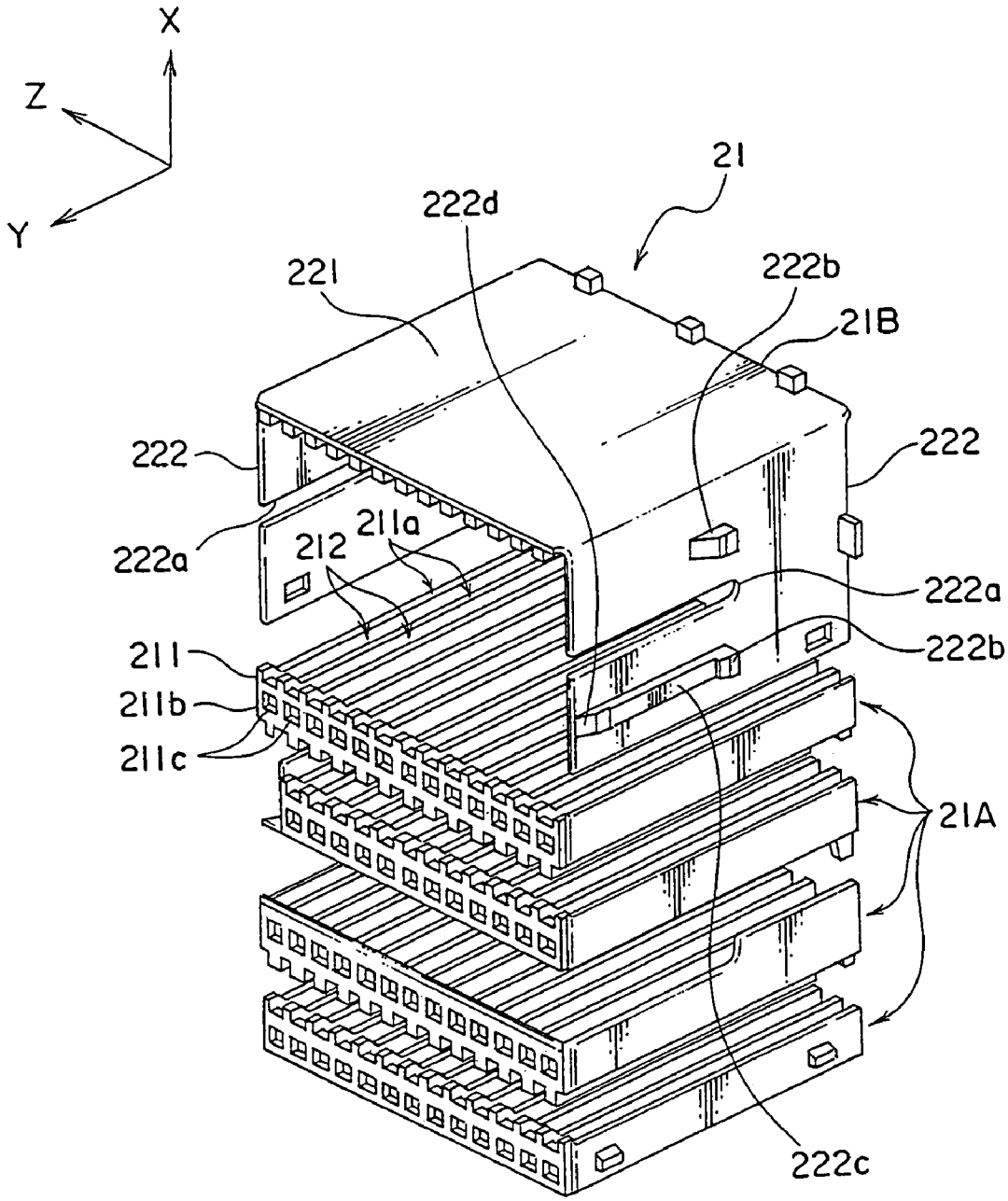
FIG. 6 is an external view showing an example of a second sub-connector shown in FIG. 5.
Figure 7:
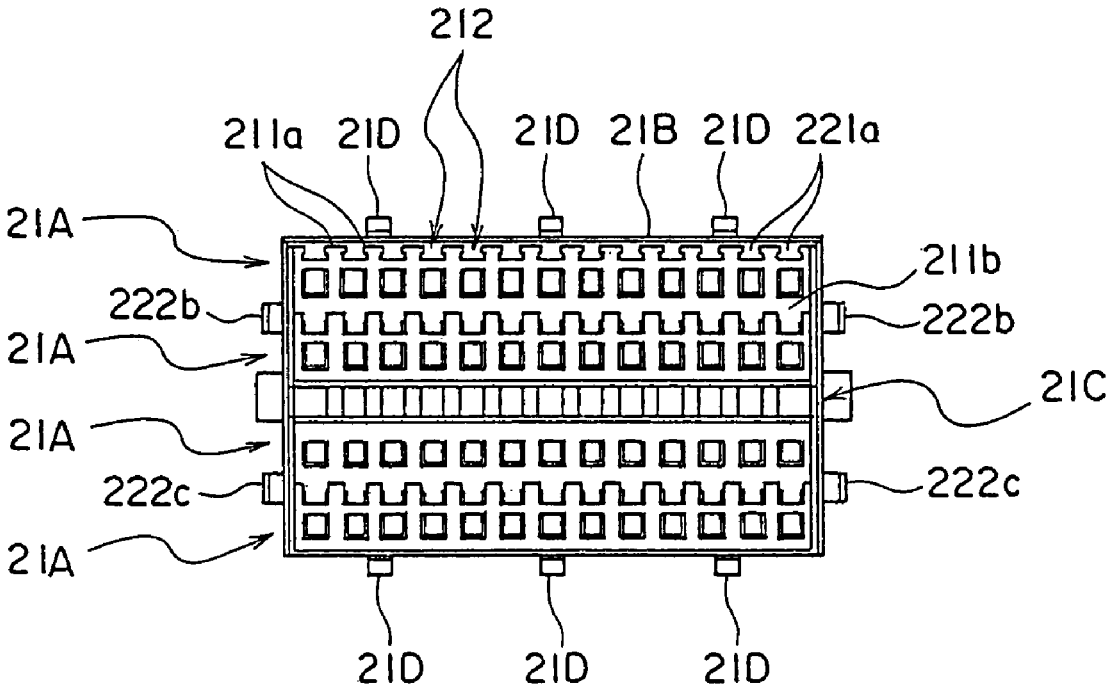
FIG. 7 is a front view of the second sub-connector shown in FIG. 6.

As shown in FIGS. 6 and 7, each of the second sub-connectors 21 includes a plurality of pressure-welded housings 21A (four in FIG. 6) and a pressure-welded cover 21B covering these pressure-welded housings 21A. The number of pressure-welded housings 21A is determined according to the number of terminals of each product, etc.

Each pressure-welded housing 21A is made of insulating synthetic resin or the like, and has a rectangular plate body 211 and a plurality of terminal accommodating grooves 212. The plate body 211 includes a bottom wall, pairs of sidewalls 211*a*, and an end wall 211*b*. The bottom wall is substantially rectangular and almost flat. Each sidewall in a pair 211*a* is opposite to and parallel to its corresponding sidewall. The sidewalls 211*a* are continuous with the edges of the bottom wall so as to extend upward from the bottom wall.

The end wall 211*b* is continuous with the bottom wall and the ends of each pair of sidewalls 211*a*. The end wall 211*b* extends upward from the bottom wall. The end wall 211*b* is continuous with the end of the bottom wall positioned on the frontal side of FIG. 6. The end wall 211*a* serves as one end described in the specification.

Each of the terminal accommodating groves 212 is defined by adjacent sidewalls 211*a* and the bottom wall. Each terminal accommodating groove 212 extends from the end wall 211*b* to the end of the plate body 211 opposite to the end wall 211*b*. The terminal accommodating grooves 212 are formed parallel to one another.

The end wall 211*b* has a plurality of parallel insertion holes 211*c* into which the terminals 13B of the first sub-connector 13 are inserted. Each of the insertion holes 211*c* is a through-hole that is continuous with the corresponding terminal accommodating groove 212. Each terminal 13B inserted through the corresponding insertion hole 211*c* is further inserted into the corresponding terminal accommodating groove 212 and electrically connected to the pressure-welded terminal 29.

Each pressure-welded housing 21A accommodates the pressure-welded terminals 29 in the terminal accommodating groove 212 selected arbitrarily from among the plurality of terminal accommodating grooves 212. The pressure-welded housings 21A are stacked such that the plate bodies 211 accommodating the pressure-welded terminals 29 are parallel to one another. Each second sub-connector 21 is constructed in this way.

Figure 9:
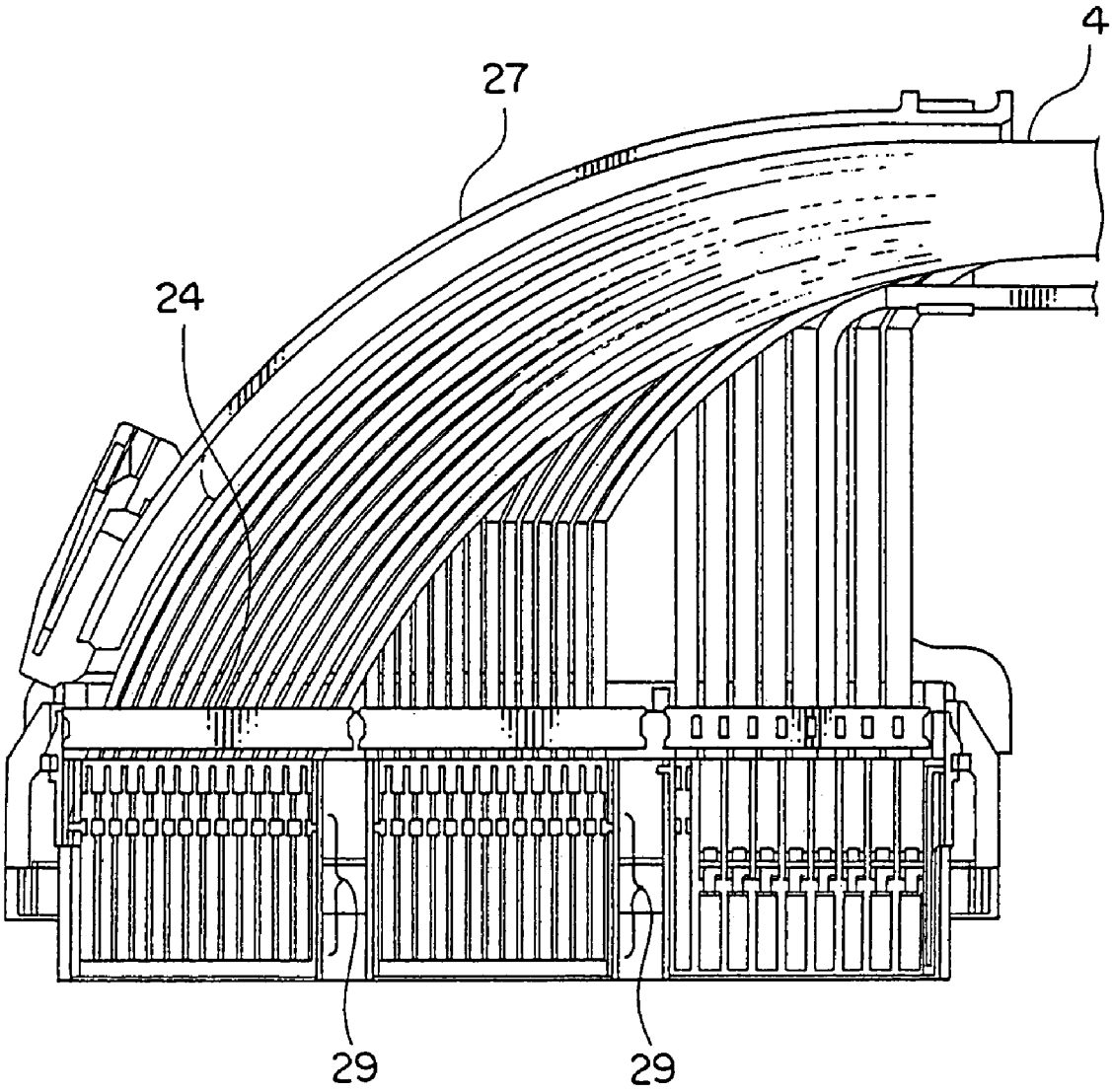
FIG. 9 is a sectional view taken along the line A-A indicated by the arrows in FIG. 1.
Figure 10:
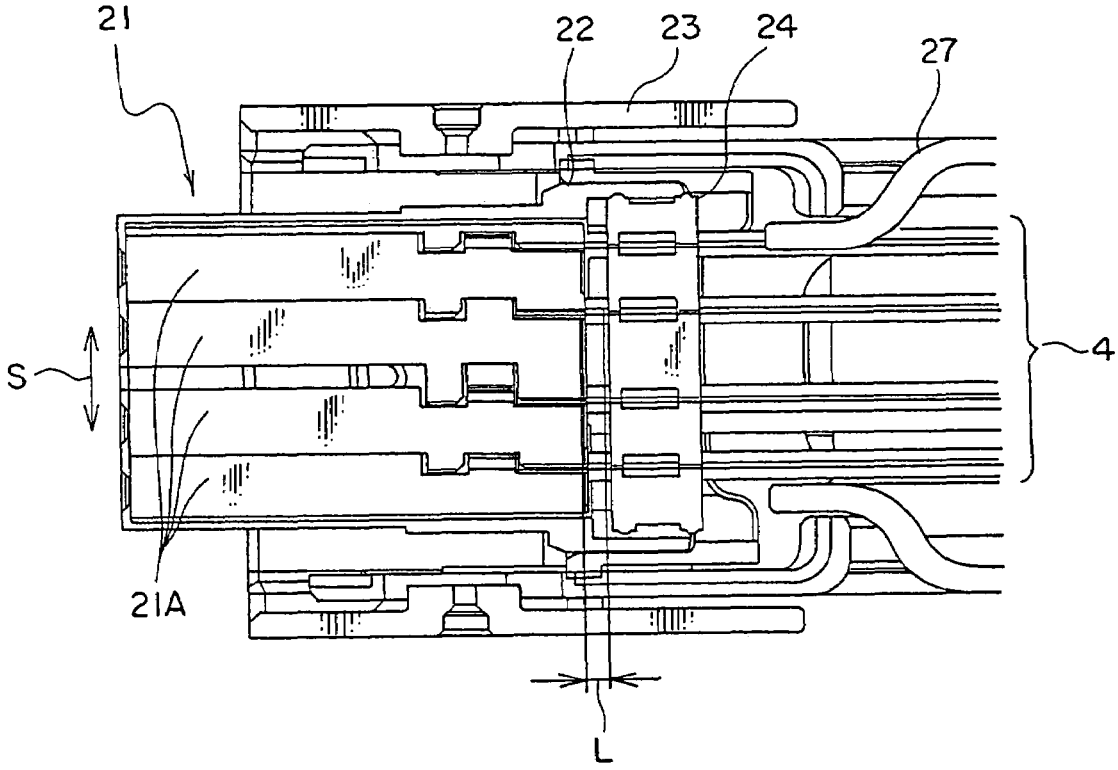
FIG. 10 is a sectional view taken along the line B-B indicated by the arrows in FIG. 1.

In this case, as shown in FIG. 9, electric wires 4 are pressure-welded to the pressure-welded terminals 29 accommodated and held in each pressure-welded housing 21A. As shown in FIG. 10, the pressure-welded housings 21A with the electric wires 4 attached thereto are stacked one on another. Each electric wire 4 has a conductive core wire and a covering, made of insulating synthetic resin, which covers the core wire. When the second-sub-connector 21 is constructed after the pressure-welded housings 21A are stacked, the pressure-welded cover 21B is arranged so as to cover the top and both sides of the stack of pressure-welded housings 21A, as shown in FIG. 6.

In the-second sub-connector, as shown in FIG. 7, four pressure-welded housings 21A arranged in a stack have a space 21C between the second and third housings 21A, that is, the middle of the stack. The aforementioned guide pieces 12D of the female fitting part 12 are inserted into the space 21C.

Each pressure-welded cover 21B is made of insulating synthetic resin or the like. The pressure-welded cover 21B has: a top wall 221 covering the uppermost pressure-welded housing 21A; and a pair of sidewall covers 222 vertically extending from the top wall 221. The top wall 221 is rectangular, which is almost identical in shape to the pressure-welded housing 21A. Formed on the internal face of the top wall 221 are projections 221*a* which fit in the terminal accommodating groves 212 of the pressure-welded housing 21A. The projections 221*a* extend from one end of the top wall 221 to the other end along the terminal accommodating groves 212.

Each sidewall cover 222 is rectangular, which is almost identical in shape to the sides of the stack of pressure-welded housings 21A. Each sidewall cover 222 has a sidewall slit 222*a*, engagement projections 222*b*, and an abutting part 222*c*. The sidewall slit 222*a* extends from the center of the sidewall cover 222 to the edge thereof in direction Y as shown in FIG. 6. The sidewall slit 222*a* is continuous with the space 21C, into which the corresponding guide piece 12D of the female fitting part 12 is inserted to regulate the range of insertion.

The engagement projections 222*b* each have a projecting form inclining in direction Y as shown in FIG. 6. The engagement projections 222*b* are arranged in a pair such that the sidewall slit 222*a* is located therebetween. They are engaged with the long holes (described below) of the fitting part 22, thereby positioning the second sub-connector 21 in the fitting part 22. The positions and the number of the engagement projections 222*b* can be determined arbitrarily.

The abutting part 222*c* is formed such that the corresponding arm 13C of the first sub-connector 13 comes into contact with this part. The abutting part 222*c* projects in a rectangular form from the sidewall cover 222 and extends in the direction Y along the sidewall slit 222*a*. The abutting part 222*c* has a tapered part 222*d* formed such that when the female connector 10 and the male connector 20 are fit together, the abutting part 222*c* guides the first sub-connector 13 and the second sub-connector 21 into their connected position. The tapered part 222*d* tapers in the direction Y as shown in FIG. 6, which is the direction of insertion.

Figure 8:
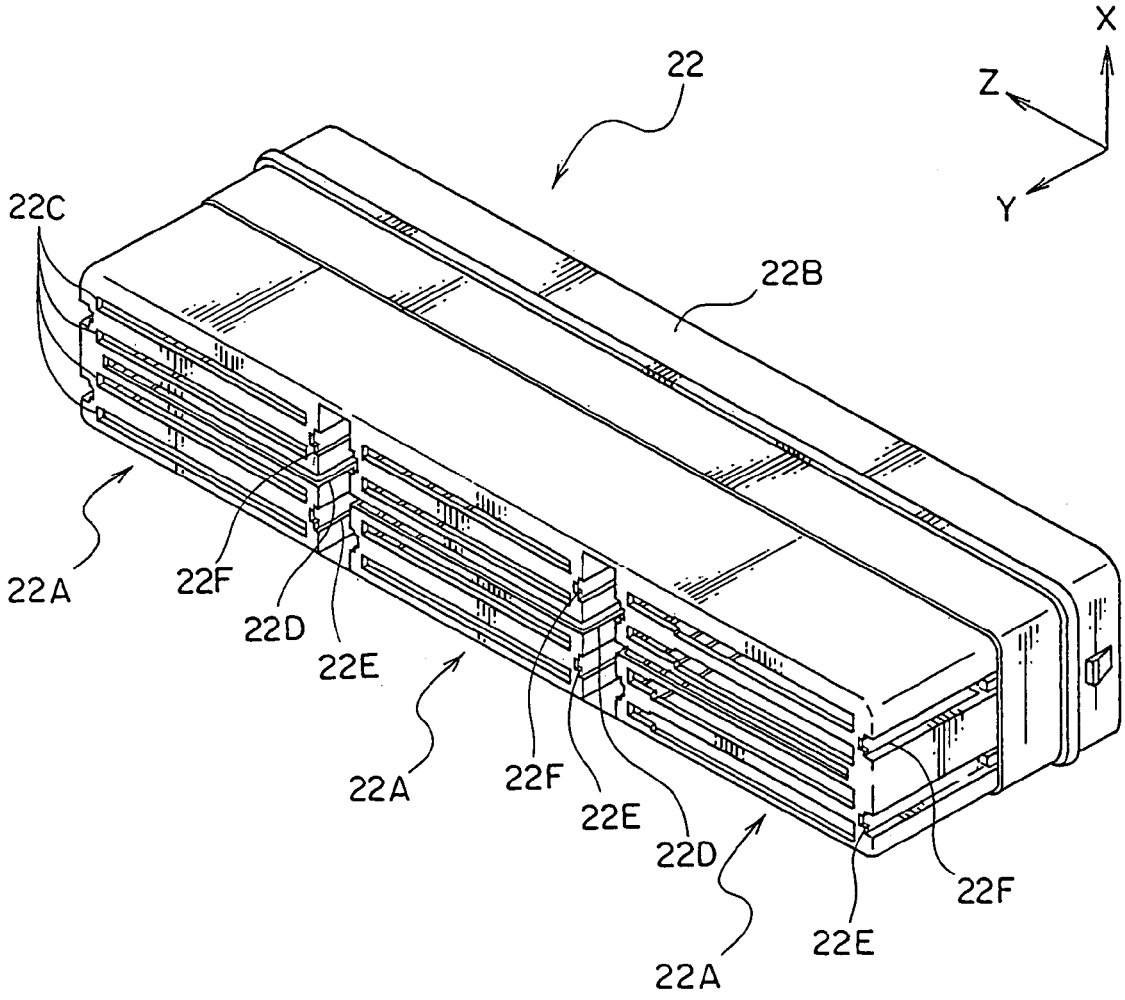
FIG. 8 is an external view showing an example of a fitting part shown in FIG. 5.

The fitting part 22 is made of insulating synthetic resin or the like and includes, as shown in FIG. 8, a plurality of accommodating parts 22A (three in FIG. 6) for accommodating the second sub-connectors 21, and a case body 22B in which the series of accommodating parts 22A are defined at predetermined intervals. The number of accommodating parts 22A is determined according to the number of the second sub-connectors 21.

Each accommodating part 22A has a shape corresponding to the outside of the second sub-connector 21. The height of the accommodating part 22A, in direction X in FIG. 8, is substantially equal to that of the second sub-connector 21 such that the accommodating part 22A can accommodate the second sub-connector 21. The width of the accommodating part 22A, in direction Z in FIG. 8, is slightly greater than that of the second sub-connector 21. The width is designed based on the sidewise movement or the like of the leading ends of the terminals 13B, which result from variations in the first sub-connectors 13. Guide grooves (not shown) in the second sub-connector 21 extending widthwise (direction Z in FIG. 6) are formed in the upper and lower internal faces of the accommodating part 22A, so that the projections 21D of the second sub-connector 21 movably fit in them. The accommodating parts 22A formed as described above prevent vertical movement of the second sub-connectors 21 accommodated in the corresponding accommodating parts 22A and allow the second sub-connectors 21 to slide only in the directions indicated by arrow S (that is, widthwise) in FIG. 10.

Each accommodating part 22A includes: through-holes 22C into which the terminals of the first sub-connector 13 are inserted; an accommodating space 22D into which the corresponding guide piece 12D of the female fitting part 12 is inserted; entry parts 22E into which the arms 13C of the first sub-connector 13 enter; and a plurality of engagement openings 22F.

Each of the through-holes 22C corresponds to the row of terminals 13B of the first sub-connector 13. Each of the through-holes 22C has the form of a slit so as to correspond to the pressure-welded housing 21A. The through-holes 22C enable the second sub-connectors 21 to be temporarily positioned in the corresponding first sub-connectors 13. Accordingly, the connector 1 may easily be fit.

In the preferred embodiment, a description is given in the case where each opening 22C has a slit form. However, the through-holes 22C may have various shapes corresponding to the terminals 13B. The through-holes 22C having a slit form can accept variations, which result from manufacturing tolerance in the terminals 13B.

Each accommodating space 22D has a slit form so as to be continuous with the foregoing space 21C. The guide piece 12D of the female fitting part 12, inserted in the accommodating space 22D, is subsequently inserted into the space 21C, thereby temporarily positioning the second sub-connector 21 in the first sub-connector 13 in a vertical direction (direction X in FIG. 8).

The entry parts 22E are defined on both sidewalls of each accommodating part 22A. Each entry part 22E has the form of an indentation extending in the direction in which the second sub-connector 21 is inserted (direction Y in FIG. 8). As the second sub-connector 21 is accommodated into the accommodating part 22A, the abutting parts 222*c* of the second sub-connector 21 fit into the entry parts 22E, and thus, the second sub-connector 21 is positioned in the accommodating part 22A. Arms 13C of the first sub-connector 13 enter the corresponding entry parts 22E, thereby coming into contact with the abutting parts 222*c* of the second sub-connector 21. In the preferred embodiment, the entry parts 22E have a slit form because a predetermined space is left between the adjacent accommodating parts 22A. However, the entry part 22E may take any form such as a through-hole.

The engagement openings 22F have an indentation form that is the same as the entry parts 22E, and are formed on both sidewalls of each accommodating part 22A along the entry parts 22E. As the second sub-connector 21 is accommodated into the accommodating part 22A, the engagement projections 222*b* of the second sub-connector 21 fit into the entry parts 22E, thereby positioning the second sub-connector 21 in the accommodating part 22A. The engagement openings 22F may be formed in both the sidewalls of each accommodating part 22A.

The holder 23 is made of insulating synthetic resin or the like. By covering part of the male fitting part 22 accommodating the second sub-connectors 22, the holder 23 fixes the male fitting part 22 in position. The holder 23 has fixing parts (not shown), which fix the sealing members 24 to the corresponding second sub-connectors 21 with a predetermined space L left between them, as shown in FIGS. 9 and 10. The holder 23 axially bears the lever 26 such that the first sub-connectors 13 and the second sub-connectors 21 fit into their connections simultaneously. Additionally, the holder 23 has an axial bearing part (not shown) which axially bears the cover 27.

The sealing members 24 each have a mat seal 24A and a mat seal cover 24B. The mat seal 24A is made of an insulating elastic member and has holes through which the electric wires 4 are made to pass. The mat seal 24A restricts movement of the electric wires 4. The mat seal cover 24B is made of insulating synthetic resin, and is fixed in the holder 23 while it holds the mat seal 24A. Since the sealing member 24 formed as describe above absorbs any external force transmitted from the electric wires 4 connected to the second sub-connector 21, transmission of such an external force to the pressure-welded terminals 29 is prevented.

The lever 26 may be rotated while being axially supported by the holder 23. By the action of a lever rule accompanying the rotation, the lever 26 pulls the female sub-connector 10 and the male sub-connector 20, and fits the first sub-connectors 13 and the corresponding second sub-connectors 21 into their connections simultaneously.

The cover 27 is made of insulating synthetic resin or the like, and is shaped such as to be continuous with the edges of the holder 23. The cover 27 binds together electric wires 4 connected to the second sub-connectors 21 and externally guides the electric wires 4. These externally guided electric wires 4 are bound together by a tie wrap belt 20B and fixed to the cover 27. Therefore, an external force applied to the electric wires 4 is absorbed by the cover 27 fixed by the tie wrap belt 20B, and the external force remaining in the cover 27 is further absorbed by the sealing members 24. This reduces the external force applied to the pressure-welded terminals 29.

The waterproof member 28 is made of synthetic resin or the like. When the male fitting part 22 of the male connector 20 and the female fitting part 12 of the female connector 10 are fit into their connections, the waterproof member 28 is interposed between the fitting parts 22 and 12 and seals the gap between them to prevent entry of liquid such as water. This eliminates the need to provide the first sub-connector 13 and second sub-connector 21 with waterproofing or the like. This easily meets any demand for an increase in the number of the first sub-connectors 13 and second sub-connectors 21 of the waterproof connector 1.

The male connector 10 described above is assembled in a manner as follows. The second sub-connectors 21 with the electric wires 4 connected to them are first fit in the corresponding accommodating parts 22A so as to be freely movable widthwise. Then, the male fitting part 22 is fit in the holder 23. Subsequently, the sealing members 24 through which the electric wires 4 have passed are fit in the holder 23. Also, the lever 26 and the cover 27 are fit to the holder 23 so as to be freely rotatable. Thus, the male connector 20 is completed.

Figure 11:
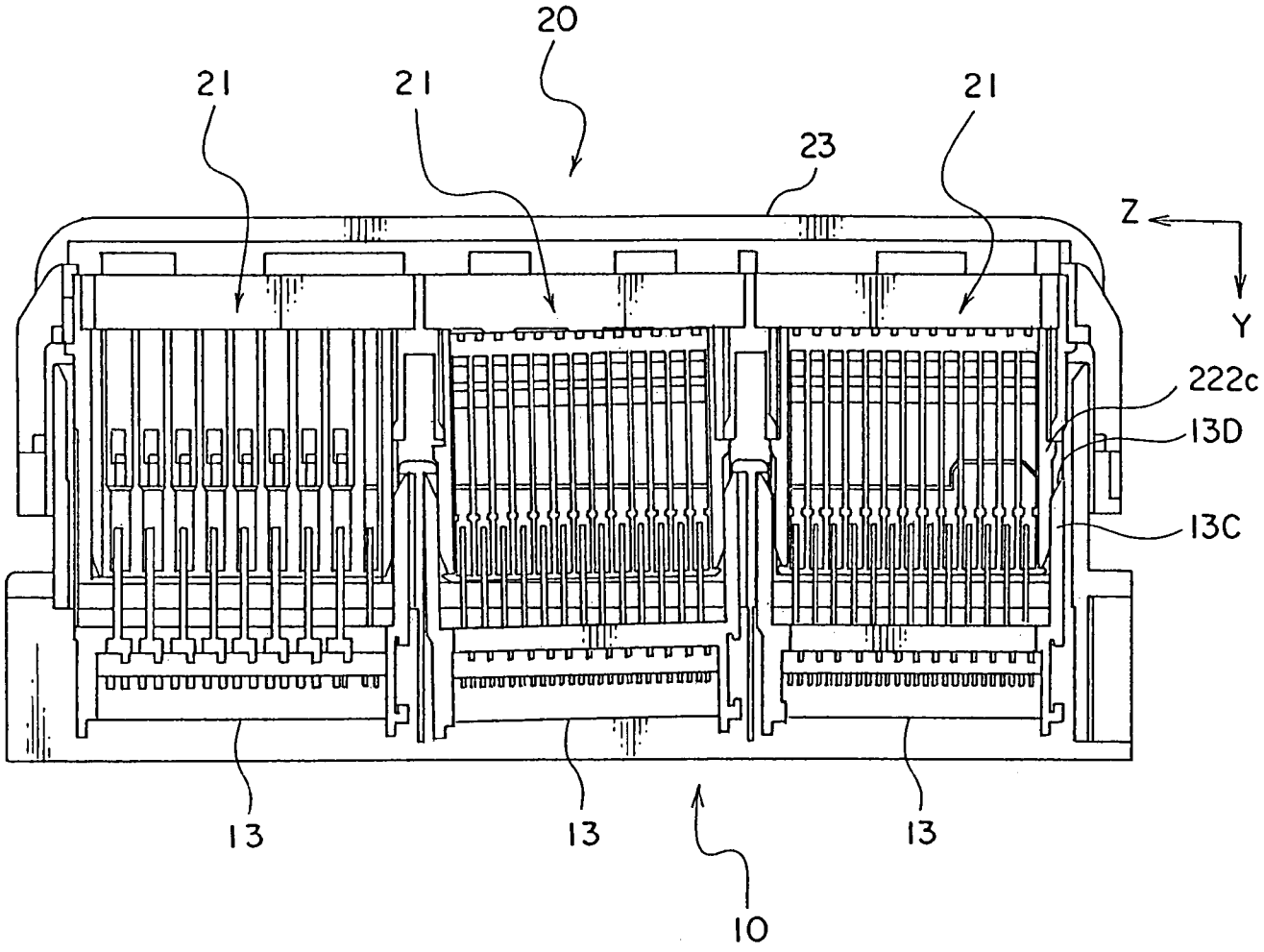
FIG. 11 is a schematic view for explaining the relations between the first sub-connectors and the second sub-connectors.

Referring mainly to FIGS. 11 and 12, the connection of the above-mentioned connector 1 will now be explained.

Figure 12A:
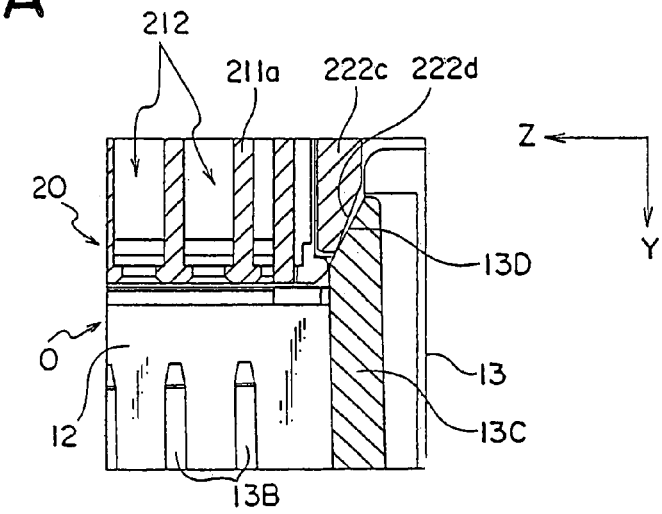
FIG. 12A is a view for explaining an example of connection of the first sub-connector and the second sub-connector, and shows a state of each tapered part being in contact with an abutting part.

As shown in FIG. 11, the male connector 20 is aligned to the female connector 10 such that the first sub-connectors 13 and the corresponding second sub-connectors 21 face each other. Then, the second sub-connectors 21 are moved in the direction of insertion (direction Y in FIG. 11). As a result, as shown in FIG. 12A, the tapered part 13D of the arm 13C of each first sub-connector 13 comes into contact with the tapered part 222*d* of the abutting part 222*c* of the corresponding second sub-connector 21.

Figure 12B:
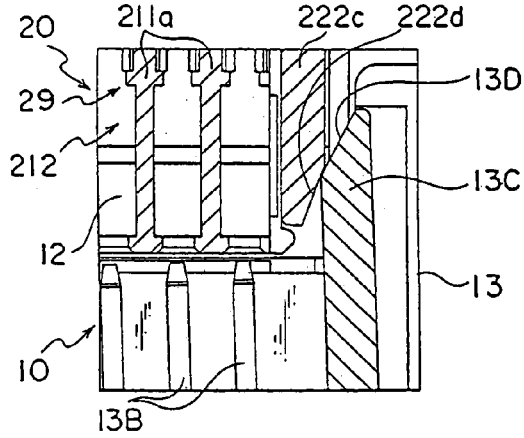
FIG. 12B is the view for explaining the example of connection of the first sub-connector and the second sub-connector, and shows each tapered part sliding widthwise.
Figure 12C:
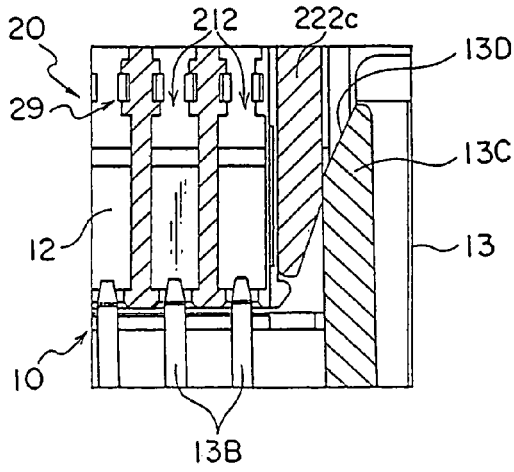
FIG. 12C is the view for explaining the example of connection of the first sub-connector and the second sub-connector, and shows a state of each tapered part after slid.

While further moved in the direction of insertion (direction Y), each second sub-connector 21 slides to the left (direction Z) in FIG. 12 due to the contact of the tapered part 13D of the first sub-connector 13 with the tapered part 222*d* of the corresponding second sub-connector 21, as shown in FIG. 12B. Consequently, the terminal accommodating grooves 21 of the second sub-connector 21 slide into a position where the terminals 13B of the first sub-connector 13 can be inserted into the corresponding grooves, as shown in FIG. 12C. When each second sub-connector 21 is further moved in the direction of insertion, the terminals 13B of the first sub-connector 13 are brought into firm contact with the pressure-welded terminals 29 of the second sub-connector 21. Thereby, the terminals 13B and the pressure-welded terminals 29 are electrically connected, and thus, the first sub-connector 13 and the corresponding second sub-connector 21 are connected in the correct connected position. Accordingly, the female connector 10 and the male connector 20 are connected to each other.

According to the above-mentioned connector 1, the male fitting part 22 (male frame) of the male connector 20 defines accommodating parts 22A in which the second sub-connectors 21 are individually accommodated so as to be freely movable. The female fitting part 12 (female frame), which fits into its connection to the male fitting part 22, accommodates the first sub-connectors 13 that are connected to the corresponding second sub-connectors 22. As the male fitting part 22 fits into the female fitting part 12, each second sub-connector 21 is guided to the connected position relative to the corresponding first sub-connector 13 by guide means which comprises the arm 13C of the first sub-connector 13 and the abutting part 222*c* of the corresponding second sub-connector 21. Accordingly, even if there are variations in the terminals 13B, etc., of each first sub-connector 13 and corresponding second sub-connector 21, the second sub-connector 21 designed so as to be freely movable is guided to the connected position relative to the first sub-connector 13. Thus, the first sub-connector 13 and the second sub-connector 21 are connected and held in position. Additionally, in the case where each first sub-connector 13 has terminals 13B, the terminals 13B have been formed by mechanical processes, the tolerance of which may result in variations in the leading ends of the terminals 13B and variations in the terminal 13B. However, since each accommodating part 22A of the male fitting part 22 accommodates the second sub-connector 21 such that the second sub-connector is freely movable, the variations are absorbed such that the second sub-connector 21 can be guided to the connected position. This eliminates the need to provide biasing means, such as a displacement spring, in order to connect and fix each first sub-connector 13 and the corresponding second sub-connector 21, hence preventing a load on the terminals 13B, substrates 14*d*, etc. after connection of the first and second sub-connectors 13 and 21.

Second Embodiment

In the first embodiment, the description has been given in the case where the guide means is realized by the arms 13C and tapered parts 13D of each of the first sub-connectors 13. However, the invention is not limited thereto and may be varied as in the second embodiment. In the second embodiment, the same reference numerals refer to the identical components or corresponding parts used in the first embodiment, and explanations of these are omitted.

As shown FIG. 1, a connector 1 has one connector 10 (referred to as female connector) serving as a female frame and a plurality of mating connectors 20 (referred to as male connectors) serving as male frames which fit into its connection to the female connector 10.

Figure 13:
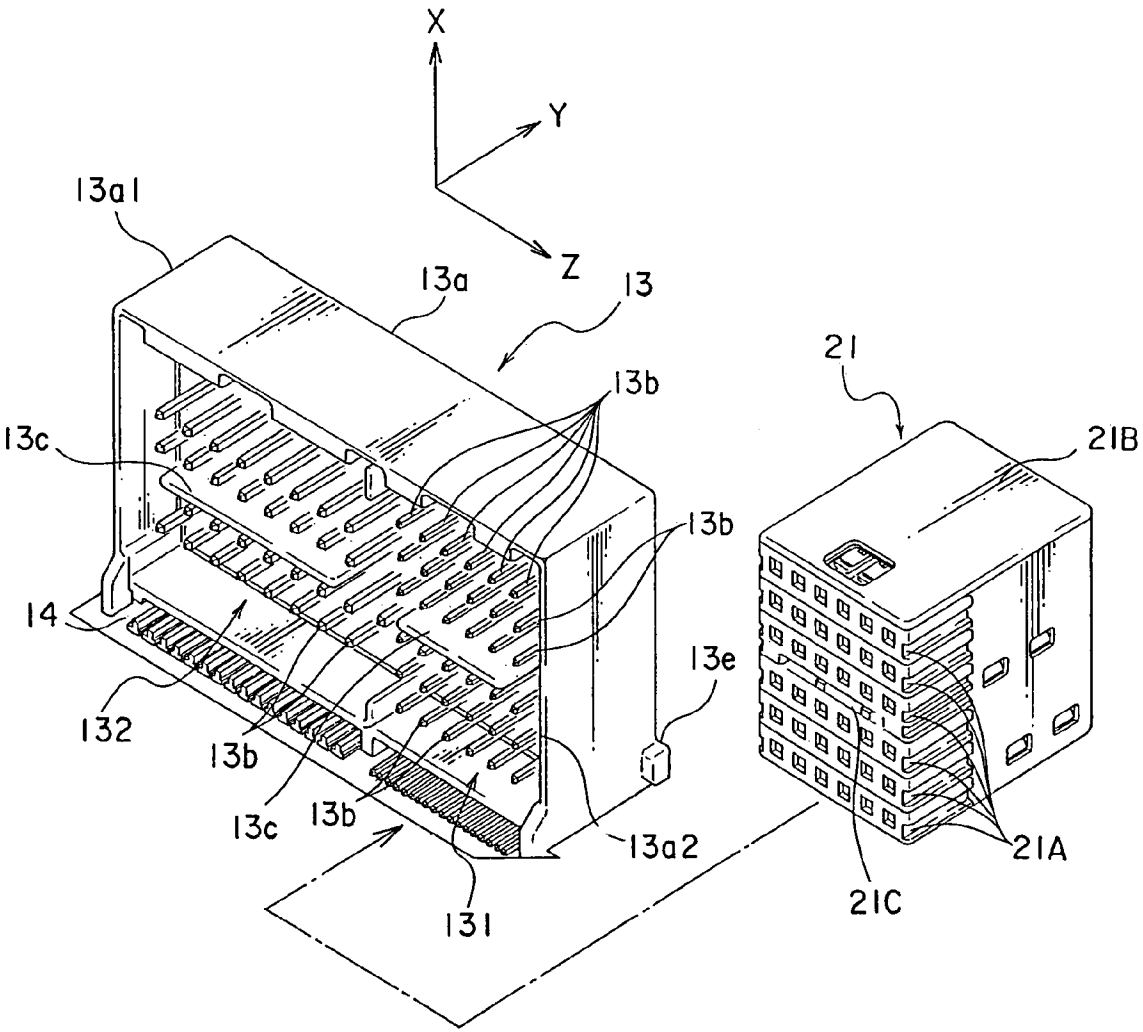
FIG. 13 is a perspective view schematically showing an example of a first sub-connector and second sub-connector according to a second embodiment.

As shown in FIGS. 1 and 13, the female connector 10 includes: a substantially box-like housing 11 made of synthetic resin or the like; female fitting parts 12 which are defined in the housing 11 and into which the corresponding male connectors 20 fit; a plurality of first sub-connectors 13 (the two first sub-connectors 13 in FIG. 13) accommodated in the housing 11; and a substrate 14 to which the first sub-connectors 13 are fixed.

As shown in FIG. 13, the first sub-connector 13 is composed of two first sub-connectors 131 and 132. Needless to say, the first sub-connector 13 may be composed of one.

Each first sub-connector 13 includes: a connector base 13*a;* a plurality of terminals 13*b* extending from the connector base 13*a* toward the corresponding second sub-connector 21; guides 13*c* extending from the connector base 13*a* towards the corresponding second sub-connector 21; tapered parts 13*d* (refer to FIG. 16) formed on the guides 13*c;* and engagement parts 13*e* formed on both sidewalls of the first sub-connector 13.

The connector base 13*a* is substantially in the shape of a box, made of a synthetic resin or the like, and has a peripheral wall 13*a*1. The peripheral wall 13*a*1 surrounds a plurality of terminals 13*b* arranged by means of insert molding or the like, and has an opening 13*a*2.

As described above, each of the terminals 13*b* is of a metal plate material or composite member formed in a predetermined shape. In the one first sub-connector 131, six lines of six terminals 13*b* are arranged in the direction X in FIG. 13. In the other first sub-connector 132, four lines of eight terminals 13*b* are arranged in the direction X in FIG. 13. In the preferred embodiment, the description of the first sub-connector 13 will be given using the first sub-connector 131 as the first sub-connector 13 in order to simplify the description.

Each terminal 13*b* is substantially L-shaped such that its one end extends toward the second sub-connector 21 as described above and its other end projects from the bottom of the connector base 13*a* toward the substrate 14. The other end of each terminal 13*b* is made to pass through the terminal hole of the substrate 14, soldered or press-fit, and thereby electrically connected to a wiring pattern formed on the substrate 14.

Each guide part 13*c* has the form of a plate extending from the connector base 13*a* toward the second sub-connector 21. Specifically, the guide part 13*c* has the shape of a wide flat plate that is narrower than the width along which the six terminals 13*b* are arranged, and is arranged in the middle of the vertical lines of terminals 13*b* (i.e., between the third and fourth horizontal lines). In the case of the first sub-connector 132, the guide part 13*c* is formed so as to be narrower than the width along which the eight terminals 13*b* are arranged, and is arranged in the middle of the vertical lines of terminals 13*b* (i.e., between the second and third horizontal lines). The shape and position of each guide part can be determined according to the dimensions, shape, etc., of the corresponding sub-connector 13.

Taking account of the maximum error of the second sub-connector 21, the width, thickness, etc., of each guide part 13*c* are determined such that the guide part 13*c* enters the male connector 20 and then comes into contact with the guide hole 21C of the corresponding second sub-connector 21. The guide part 13*c* extends further forward than one end of each terminal 13*b* or extends the distance that is almost equal to the length of each terminal 13*b*. Even if the maximum error occurs in the second sub-connector 21, the first sub-connector can come into contact with the second sub-connector 21 by the guide part 13*c*.

Figure 16B:
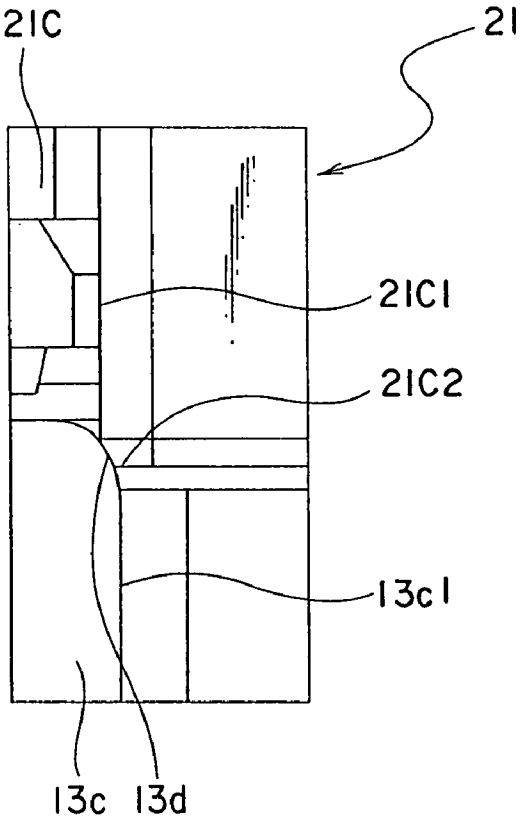
FIG. 16B is the view for explaining the example of connection of the first sub-connector and second sub-connector being fit together, and shows an enlarged view of an area indicated by M in (b)

As shown in FIG. 16B, each guide part 13*c* has tapered parts 13*d* near the leafing ends of their sidewalls 13*c*1 in the direction of the guide hole 21C of the corresponding second sub-connector 21. Tapered parts 13*d* are shaped such that when the female connector 10 and the male connector 20 are fit together, the first sub-connector 13 and the second sub-connector 21 are guided to the predetermined connected position. For example, each tapered part 13*d* is shaped such that as the tapered part 13*d* is moved in the direction of insertion (direction Y in FIG. 13), the tapered part 13 gradually comes into contact with the sidewall 13*c*1 and the internal wall 21C1 of the guide hole 21C of the second sub-connector 21. Accordingly, when the guide part 13*c* is completely fit into the guide hole 21C, movement of the guide part 13*c* is restricted and also the position of the guide part 13*c* is corrected by the faces of the guide hole 21C.

Each engagement part 13*e* is temporarily positioned on a predetermined position of the substrate 14 by its being engaged with a locking piece (not shown) projecting from the surface of the substrate 14. Formed on the substrate 14 is a wiring pattern (not shown) comprising a circuit by its being connected to each terminal 13*b*, etc., of the first sub-connector 13. Terminals, electric wires, etc. (not shown) are externally connected to the substrate 14, thereby supplying power or outputting or inputting various signals via the terminals 13*b*.

The female connector 10 described above is accommodated into the housing 11 after each first sub-connector 13 is mounted on the predetermined position of the substrate 14. Namely, the terminals 13*b* of each of the first sub-connectors 13 are arranged in the corresponding female fitting part 12 so as to extend in the direction of the second sub-connector 21. Thus, the female connector 10 is completed.

Just as the foregoing first embodiment, the male connector 20 includes: a plurality of second sub-connectors 21, each forming a pair with the corresponding first sub-connector 13: a fitting part 22 for accommodating the second sub-connectors 21; a holder 23 for accommodating the fitting part 22 and the second sub-connectors 21; sealing members 24 provided so as to correspond with the second sub-connectors 21; a lever 26 for receiving and connecting the first sub-connectors 13 and second sub-connectors 21 simultaneously; a cover 27 covering electric wires 2 connected to the second sub-connectors 21; and a waterproof member 28.

As shown in FIG. 13, each second sub-connector 21 includes a plurality of pressure-welded housings 21A, and a pressure-welded cover 21B covering the pressure-welded housing 21A. The second sub-connector 21 incorporates pressure-welded housings 21A (six pressure-welded housings 21A in FIG. 13) arranged in a stack. Defined between the third and fourth pressure-welded housings 21A is the aforementioned guide hole 21C into which the guide part 13*c* fits. The guide hole 21C has the form of a slit shaped to match the guide part 13*c*. Specifically, the upper face or lower face of the plate body 211 of an arbitrary pressure-welded housing 21A has a recess to define the guide hole 21C.

Each pressure-welded housing 21A accommodates the pressure-welded terminals 29 in the terminal accommodating grooves 212 selected arbitrarily from among the plurality of terminal accommodating grooves 212. The pressure-welded housings 21A are stacked such that the plate bodies 211 accommodating the pressure-welded terminals 29 are parallel to one another. Each second sub-connector 21 is constructed in this way. In addition, a fitting part 22 is formed near the middle of the second sub-connector 21. After the pressure-welded housings 21A are arranged in a stack to compose the second sub-connector 21, the top and both sides of the stack of pressure-welded housings 21A are covered with the pressure-welded cover 21B, as shown in FIG. 6.

The male connector 20 described above is assembled in a manner as follows. The second sub-connectors 21 with the electric wires 4 connected thereto are first fit in the corresponding accommodating parts 22A so as to be freely movable widthwise. Then, the fitting part 22 is fit in the holder 23. Subsequently, the sealing members 24 through which the electric wires 4 have passed are fit in the holder 23. Also, the lever 26 and the cover 27 are fit to the holder 23 so as to be freely rotatable. Thus, the male connector 20 is completed.

Additionally, the female connector 10 according to the second embodiment includes a temporary position control part 15 that controls the temporary position of the female connector 10 relative to the male connector 20 by its abutting on the sidewalls 22G of the fitting part 22 of the male connector 20. The temporary position control part 15 makes it possible to correctly position the female connector 10 relative to the male connector 20 when the connectors 10 and 20 are fit together.

An example of fitting the above-described connector 1 according to the second embodiment will now be explained with reference to FIGS. 14 to 16.

Figure 14:
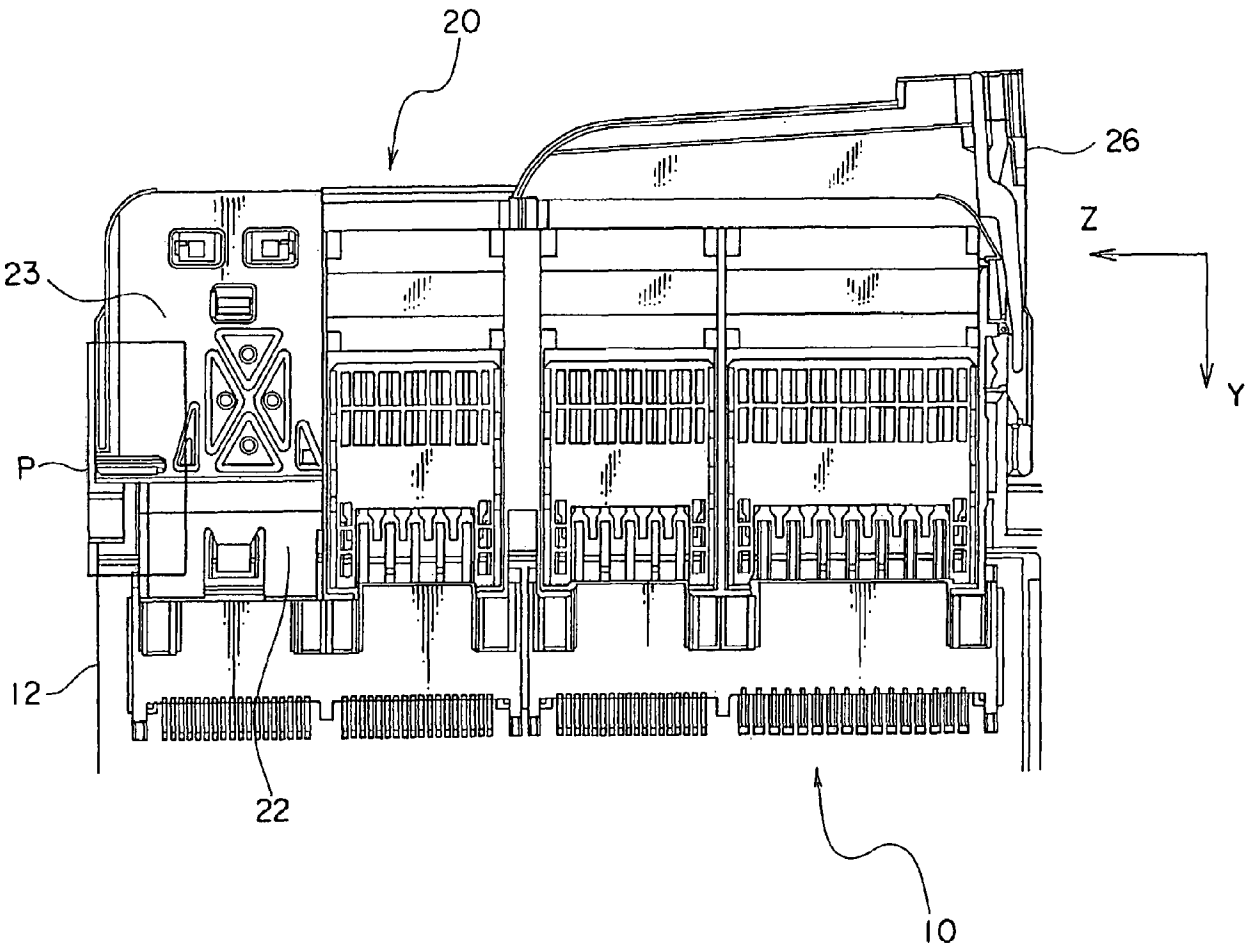
FIG. 14 is a view for explaining a state in which one connector and a mating connector according to the second embodiment start fitting together.
Figure 15:
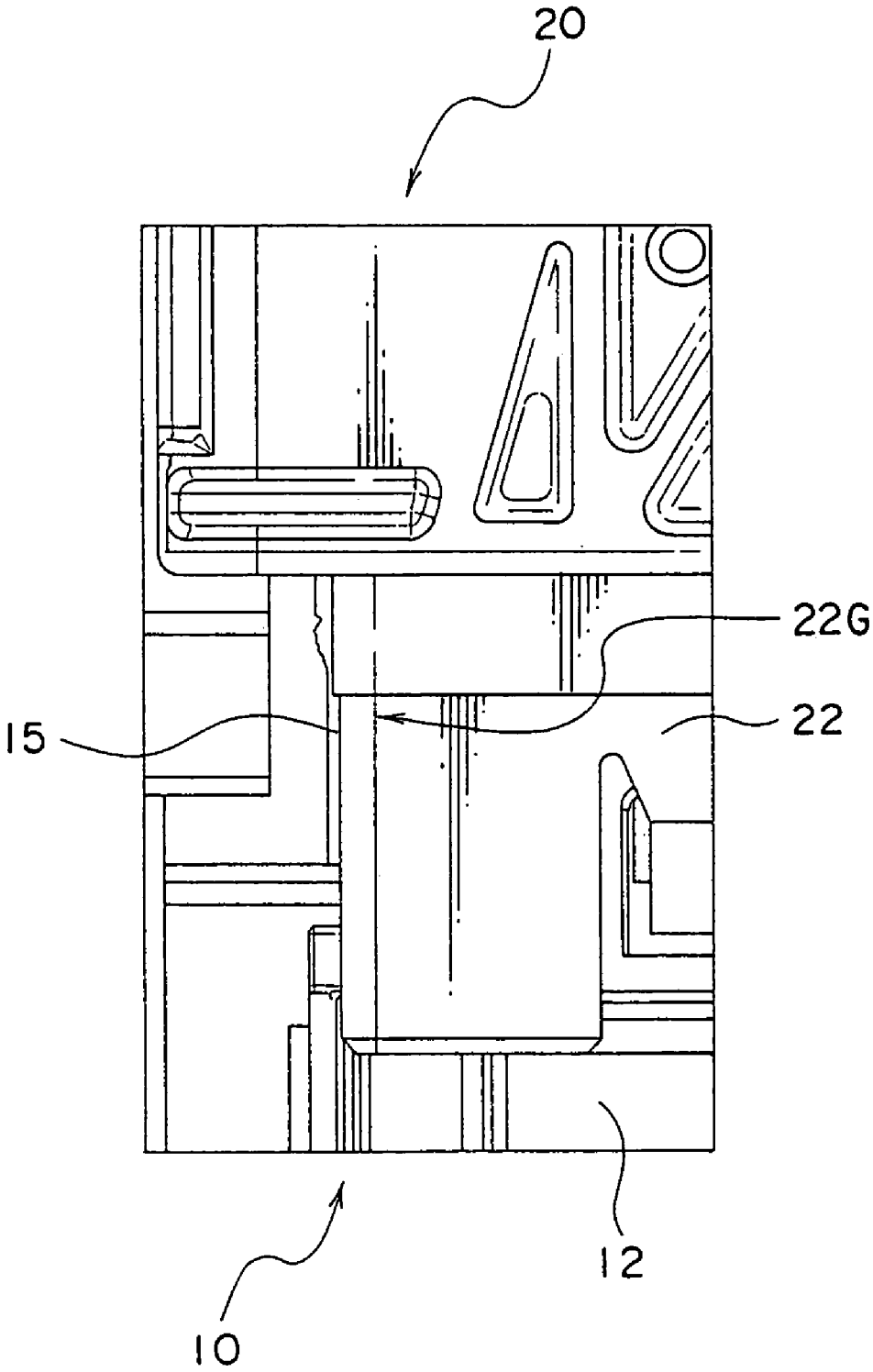
FIG. 15 is an enlarged view of an area indicated by P in FIG. 14.
Figure 16A:
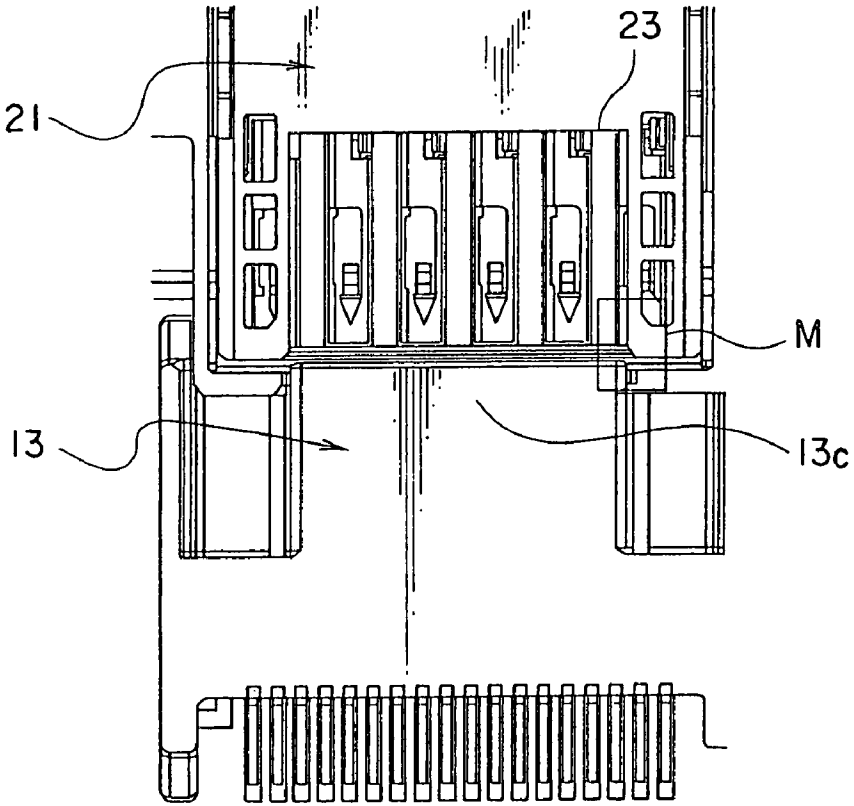
FIG. 16A is a view for explaining an example of connection of the first sub-connector and second sub-connector being fit together, and schematically shows a state of the connection.

As shown in FIGS. 14 and 15, when the temporary position control part 15 brings the female connector 10 and male connector 20 into the connected position, the second sub-connector 20 is moved in the direction of insertion (direction Y in FIG. 14). Consequently, the guide part 13*c* of the first sub-connector 13 is brought into contact with the end 21C2 of the guide hole 21C of the second sub-connector 21, as shown in FIG. 16.

Figure 17B:
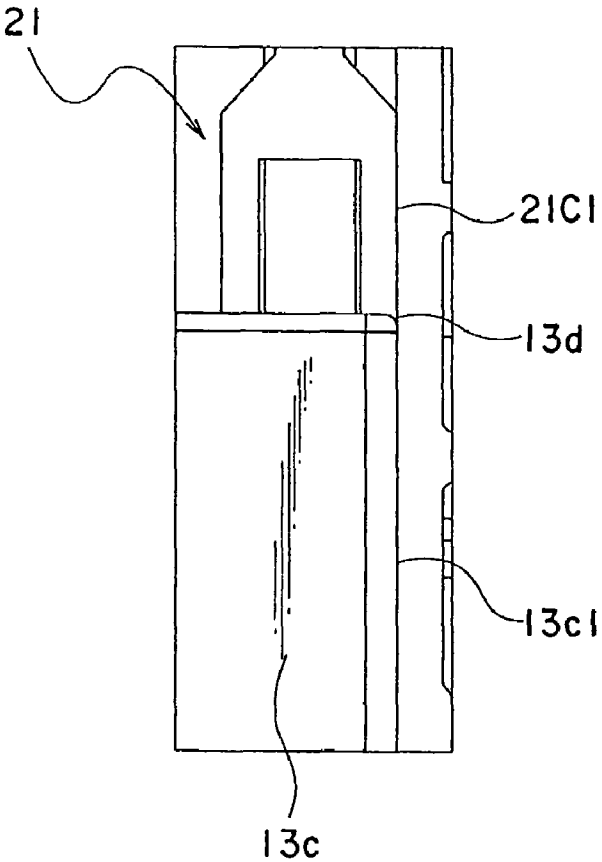
FIG. 17B is the view for explaining the example of connection of the first sub-connector and second sub-connector fit into their connections, and shows an enlarged area indicated by M in FIG. 17A.
Figure 17A:
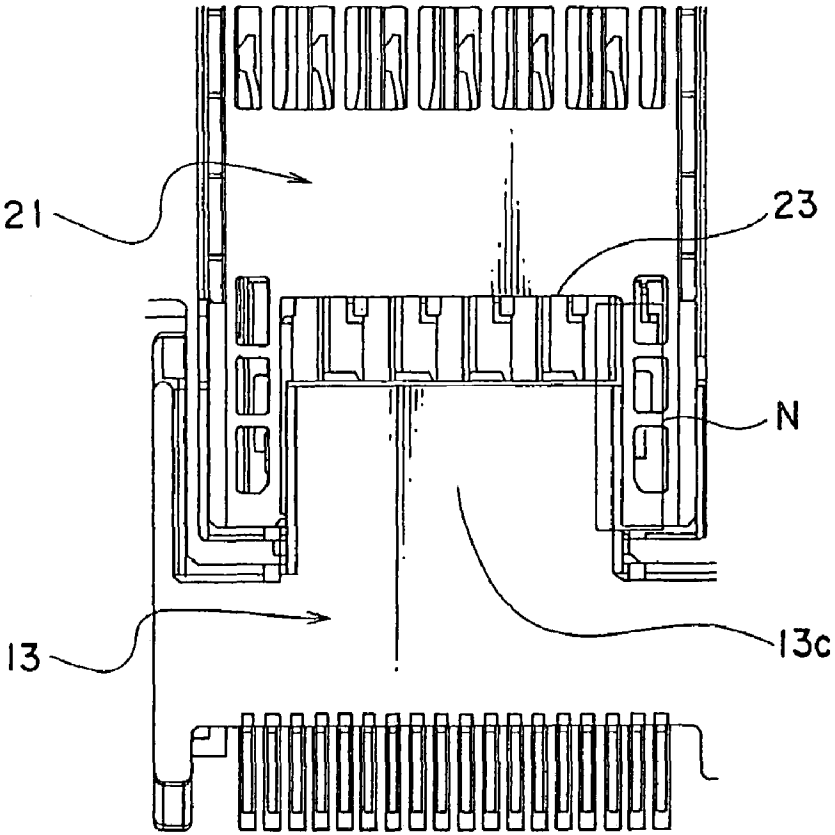
FIG. 17A is a view for explaining an example of connection of the first sub-connector and second sub-connector fit into their connections, and schematically shows a state of the connection.

While further moved in the direction of insertion (direction Y), each second sub-connector 21 slides to the left (direction Z) in FIG. 14 due to the contact of the tapered part 13*d* of the first sub-connector 13 with the end 21C2 of the second sub-connector 21, as shown in FIG. 17. Consequently, the terminal accommodating grooves 212 of the second sub-connector 21 slide into a position where the terminals 13*b* of the first sub-connector 13 can be inserted into the corresponding grooves. When each second sub-connector 21 is further moved in the direction of insertion, the terminals 13*b* of the first sub-connector 13 are brought into firm contact with the pressure-welded terminals 29 of the second sub-connector 21. Thereby, the terminals 13*b* and the pressure-welded terminals 29 are electrically connected, and thus, the first sub-connector 13 and the corresponding second sub-connector 21 are connected in the correct connected position. Accordingly, the female connector 10 and the male connector 20 are fitted together.

According to the above-mentioned connector 1, the fitting part 22 (male frame) of the male connector 20 defines accommodating parts 22A in which the second sub-connectors 21 are individually accommodated so as to be freely movable. The female fitting part 10 (female frame), which fits into its connection to the male fitting part 22, accommodates the first sub-connectors 13 that are connected to the corresponding second sub-connectors 22. As the male fitting part 22 fits into the female fitting part 12, each second sub-connector 21 is guided to the connected position relative to the corresponding first sub-connector 13 by guide means which comprises the guide part 13*c* of the first sub-connector 13 and the guide hole 21C of the corresponding second sub-connector 21. Accordingly, even if there are variations in the terminals 13*b*, etc., of each first sub-connector 13 and corresponding second sub-connector 21, the second sub-connector 21 designed so as to be freely movable is guided to the connected position relative to the first sub-connector 13. Thus, the first sub-connector 13 and the second sub-connector 21 are connected and held in position. Additionally, in the case where each first sub-connector 13 has the terminals 13*b*, the terminals 13*b* have been formed by mechanical processes, the tolerance of which may result in variations in the leading ends of the terminals 13*b* and variations in the terminal 13*b*. However, since each accommodating part 22A of the fitting part 22 accommodates the second sub-connector 21 such that the second sub-connector 21 is freely movable, the variations are absorbed such that the second sub-connector 21 can be guided to the connected position.

This eliminates the need to provide biasing means, such as a displacement spring, in order to connect and fix each first sub-connector 13 and the corresponding second sub-connector 21. As a consequence, a load is prevented from being generated on the terminals 13*b*, substrates 14*d*, etc. during and after connection of the first and second sub-connectors 13 and 21. Additionally, each first sub-connector and the corresponding second sub-connector, which are the smallest unit, are positioned relative to each other. This further reduces the load applied on the terminals 13*b*. Moreover, this assures fitting accuracy without demanding high precision in mounting the substrate 14 of the female connector 10.

In the preferred embodiments, the descriptions have been given in the case where the first sub-connector 13 is a male connector and the second sub-connector 21 is a female connector. However, the invention is not limited thereto, and the first sub-connector 13 may be a female connector and the second sub-connector may be a male connector.

What is claimed is:

1. A connector including a plurality of first sub-connectors fixed to a substrate and a plurality of second sub-connectors paired with the corresponding first sub-connectors, comprising:

a male frame having a plurality of accommodating parts in which the second sub-connectors are separately accommodated so as to be freely movable a female frame into which the male frame fits, the female frame being adapted to accommodate the plurality of first sub-connectors such that the first sub-connectors are connected to the corresponding second sub-connectors; and guide means for guiding each of the second sub-connectors into a connected position relative to the corresponding first sub-connectors, wherein the guide means comprises:

arms which extend from each of the first sub-connectors toward the corresponding second sub-connector, and enter the male frame so as to come into contact with the second sub-connector;

abutting parts formed on each second sub-connector, each abutting part being adapted such that the corresponding arm can be brought into contact with the abutting part; and tapered parts formed on at least the arms or the abutting parts, each tapered part inclining such that when the male frame and the female frame are fit together, the first sub-connector and the corresponding second sub-connector are guided into the connected position.

2. A connector including a plurality of first sub-connectors fixed to a substrate and a plurality of second sub-connectors paired with the corresponding first sub-connectors, comprising:

a male frame having a plurality of accommodating parts in which the second sub-connectors are separately accommodated so as to be freely movable;

a female frame into which the male frame fits, the female frame being adapted to accommodate the plurality of first sub-connectors such that the first sub-connectors are connected to the corresponding second sub-connectors; and guide means for guiding each of the second sub-connectors into a connected position relative to the corresponding first sub-connectors, wherein the guide means comprises:

a plate-formed guide part which extends from each first sub-connector toward the corresponding second sub-connector and enters the male frame so as to come into contact with the second sub-connector; and a guide hole defined in the corresponding second sub-connector, the guide hole being adapted to receive the guide part such that as the male frame and the female frame are fit together, the first sub-connector and the corresponding second sub-connector are guided into the connected position.

3. A connector including a plurality of first sub-connectors fixed to a substrate and a plurality of second sub-connectors paired with the corresponding first sub-connectors, comprising:

a male frame having a plurality of accommodating parts in which the second sub-connectors are separately accommodated so as to be freely movable;

a female frame into which the male frame fits, the female frame being adapted to accommodate the plurality of first sub-connectors such that the first sub-connectors are connected to the corresponding second sub-connectors; and guide means for guiding each of the second sub-connectors into a connected position relative to the corresponding first sub-connectors, wherein each of the first sub-connectors has a plurality of terminals, and the male frame has through-holes into which the terminals of the first sub-connectors are inserted.

* * * * *